US005547080A

United States Patent [19]

Klimas

[11] Patent Number: 5,547,080

[45] Date of Patent: Aug. 20, 1996

[54] SUSPENDIBLE TOOL BOX

[76] Inventor: Joseph J. Klimas, 8454 S. Kolin, Chicago, Ill. 60652

[21] Appl. No.: 293,546

[22] Filed: Aug. 22, 1994

[51] Int. Cl.[6] ..... B65D 85/20; E06C 7/14

[52] U.S. Cl. ..... 206/373; 182/129; 248/211; 248/215

[58] Field of Search ..... 206/373, 806; 312/902; 248/210, 211, 214, 215, 238; 182/33, 129

[56] References Cited

U.S. PATENT DOCUMENTS

| | | | |
|---|---|---|---|
| 3,252,613 | 5/1966 | McGrath | 248/210 X |
| 3,301,619 | 1/1967 | Mead | 206/373 X |
| 3,642,240 | 2/1972 | Hershey | 248/210 |
| 4,303,158 | 12/1981 | Perkins | 206/373 |
| 4,480,810 | 11/1984 | Hall | 248/238 |

FOREIGN PATENT DOCUMENTS

| | | | |
|---|---|---|---|
| 548891 | 1/1923 | France | 206/374 |
| 779845 | 4/1935 | France | 248/210 |
| 2124241 | 11/1972 | Germany | 206/373 |
| 144962 | 4/1954 | Sweden | 206/373 |

*Primary Examiner*—Bryon P. Gehman
*Attorney, Agent, or Firm*—Michael R. McKenna

[57] ABSTRACT

The invention relates to a tool box that has a lid that may be unobstructedly opened while the box is suspended by its own hanger from a horizontal member of a scaffold. Moreover, the tool box is designed to block rotation of the box while suspended, so that it may be opened, closed, and accessed while remaining out of the way in its hanging position on the scaffold.

14 Claims, 1 Drawing Sheet

SUSPENDIBLE TOOL BOX

BACKGROUND OF THE INVENTION

This invention relates to a tool box adapted to be suspended from a independent object such as a platform or a scaffold.

In the display box art, U.S. Pat. No. 4,160,570 teaches a box having means provided on a modular unit to allow it to be mounted on a horizontal bar attached to a vertical surface. Additionally, U.S. Pat. No. 317,220 shows the ornamental design for a storage bin having a hanger element and U.S. Pat. No. 2,770,513 discloses a service tray having a tab and hook formed at the higher end of each end wall. Said hook projects beyond the vertical plane of the adjacent side wall for engagement with a horizontal surface.

The principal disadvantage of the foregoing devices is that the hanger structure disclosed is designed to work with a specially designed horizontal bar adapted to mate with the hanger in a more of less semi-permanent arrangement. The instant invention works with a tool box laden with heavy construction tools which can be supported by any horizontal surface and particularly adapted to a scaffold.

ADVANTAGES OF THIS INVENTION

The invention relates to a tool box that has lid that may be unobstructedly opened while the box is suspended by its own hanger from a horizontal member of a scaffold. Moreover, the tool box is designed to block rotation of the box while suspended, so that it may be opened, closed, and accessed while remaining out of the way in its hanging position on the scaffold.

In the construction industry, each skilled laborer is required to furnish his or her own tools in connection with the construction services that are provided. It is often necessary that these tools be brought onto the construction site in the individual's tool box. Placement of a tool box, so that the tools are readily accessible and yet the tool box itself is not underfoot, can be problematic. The is especially true when the workspace involves an elevated ultra-hazardous space such as that which exist on a scaffold.

To alleviate this problem, and others which will become apparent from the disclosure which follows, the present invention conveniently allows the tool box to be hung from the scaffold, thus allowing it to be positioned on the perimeter of the workspace. The tool box is designed to remain stationary while suspended from the scaffold, so that it may be opened, closed, and accessed while remaining out of the way in its hanging position on the scaffold.

Still other advantages will be apparent from the disclosure that follows.

SUMMARY OF THE INVENTION

The invention relates to a tool box capable of being suspended from a horizontal surface, such as a horizontal member of a scaffold that is supported on each end by parallel vertical support members. The tool box is specifically designed to have a horizontal length of one of its vertical walls that is greater than the distance between the parallel vertical support members of a scaffold and a hanger, that is centrally disposed on the vertical wall, with a horizontal length that is less than the distance between the parallel vertical support members of the scaffold, such that when the tool box is hung on the horizontal member of the scaffold between the parallel vertical support members thereof, the section on each end of the vertical wall of the box extending beyond the centrally disposed means for suspending the box will be adjacent to one of the parallel vertical support members and rotational movement of the box about the horizontal member of a scaffold will be obstructed by contact between each of these wall sections and the adjacent parallel vertical support member.

Additionally, the tool box has a lid which is hinged horizontally to the upper surface of the vertical wall of the tool box that is opposite the vertical wall of the box on which the hanger is positioned. By positioning the lid hinge on the opposite vertical wall of the box, the lid may be opened and closed while the box is suspended from the scaffold.

BRIEF DESCRIPTION OF THE DRAWING

Preferred embodiments of the invention are described hereinafter with reference to the accompanying drawing wherein.

DETAILED DESCRIPTION OF THE INVENTION

Figure 1:
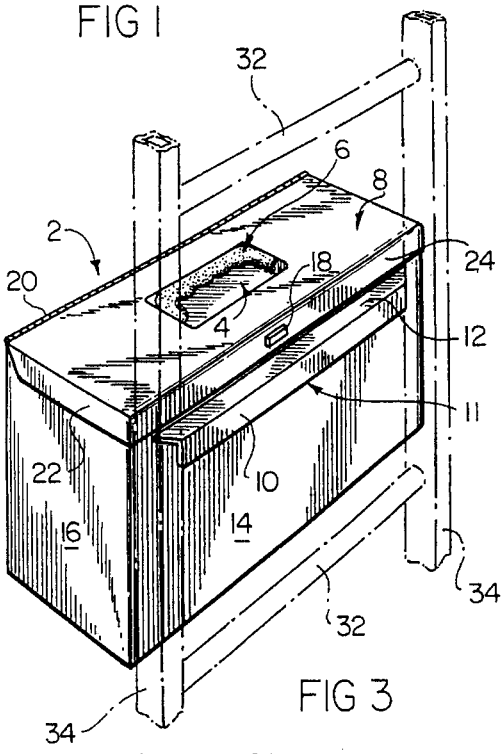
FIG. 1 is a perspective view of the tool box suspended from a scaffold (shown in phantom)

Without departing from the generality of the invention disclosed herein and without limiting the scope of the invention, the discussion that follows, will refer to the invention as depicted in the drawing.

The preferred embodiments depicted in the drawing comprise a tool box 2 having a front wall 14, a rear 36 and two side walls 16, each lying generally in a vertical plane, and a bottom wall 30, lying generally in a horizontal plane, said front wall 14 and said rear wall 36 each having their bottom edges connected to the front edge and the rear edge, respectively, of the bottom wall 30, said side walls 16 each having their bottom edges connected to the side edges, respectively, of the bottom wall 30, the front side edge of each of the side walls 16 connected, respectively, to the side edge of the front wall 14, and the rear side edge of each of the side walls 16 connected, respectively, to the side edge of the rear wall 36, a lid 8, connected to at least one of the walls lying in a generally vertical plane, with a handle 6, a means for locking said lid in a closed position 18, and a means for suspending the box operably connected to one of the vertical walls of the box 2.

As shown in FIG. 1, the means for suspending the box, shown in the drawing as a horizontal section of angle iron attached to the box arranged and adapted to suspend said box from a horizontal member 32 of a scaffold. The scaffold forms no part of the invention, it is merely an object on which the invention can be hung. The horizontal member 32 is supported on each end by a parallel vertical support member 34. A typical scaffold, manufactured by Perry Scaffolding, utilizes horizontal member with a diameter of not more than one and a half (1.5) inches and having parallel vertical support member that are positioned approximately twenty-six inches apart.

The improvements to a tool box having a front wall, a rear and two side walls, each lying generally in a vertical plane, and a bottom wall, lying generally in a horizontal plane, said front wall and said rear wall each having their bottom edges connected to the front edge and the rear edge, respectively, of the bottom wall, said side walls each having their bottom edges connected to the side edges, respectively, of the bottom wall, the front side edge of each of the side walls connected, respectively, to the side edge of the front wall, and the rear side edge of each of the side walls connected, respectively, to the side edge of the rear wall, a lid, connected to at least one of the walls lying in a generally vertical plane, with a handle and a means for locking said lid in a closed position, comprises a means for suspending the box operably connected to one of the vertical walls of said box.

It is contemplated and depicted in the drawing that the means for suspending the box is arranged and adapted to suspend said box from a horizontal member of a scaffold. It is readily understood that the means for suspending the box could easily be arranged and adapted to suspend said box from a vertical member of a scaffold as well by use of a clamp or like attachment means.

A preferred embodiment of the instant invention provides that the vertical wall 14 of the box to which the means for suspending the box is attached has a horizontal length that is greater than the distance between the parallel vertical support members 34 of a scaffold, and that the means for suspending the box is centrally disposed on said vertical wall 14 and it has a horizontal length that is less than the distance between the parallel vertical support members of a scaffold. The means for suspending the box can be positioned on the horizontal member 32 of a scaffold between the parallel vertical support members 34 of a scaffold, such that a vertical section on each end of the vertical wall 14 of the box on which the means for suspending the box is disposed extending beyond the centrally disposed means for suspending the box will be adjacent to one of the parallel vertical support members 34, to obstruct rotational movement of the box 2 about said horizontal member 32 of a scaffold by contact between each of said vertical sections of the vertical wall 14 and the adjacent parallel vertical support member 34.

A preferred embodiment of the instant invention for use with the scaffolding supplied by Perry Scaffolding or like configurations, would require a vertical wall 14 of the box to which the means for suspending the box is attached having a horizontal length that is greater than twenty-six inches with the centrally disposed means for suspending the box having a horizontal length of less than twenty-six inches.

An alternative embodiment of the instant invention not shown in the drawing comprises a tool box wherein the means for suspending the box is disposed at a spaced distance from at least one of the side edges of the vertical wall of the box to which the means for suspending the box is attached. The spaced distance is sufficient to allow a section of the vertical wall of the box to which the means for suspending the box is attached, adjacent to said side edge, to be placed in face to face relationship with one of the parallel vertical support members of a scaffold as the box is suspended from a horizontal member of the scaffold. Rotational movement of the box about the horizontal member of the scaffold will be consequently obstructed.

Figure 2:
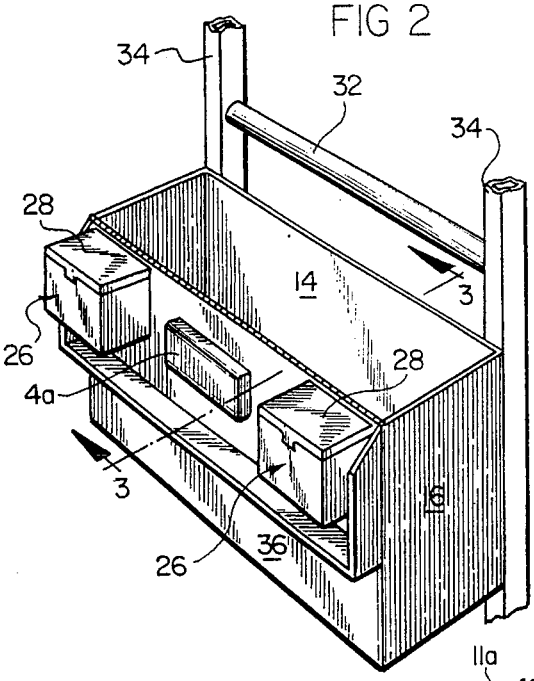
FIG. 2 is a perspective view of the tool box suspended from a scaffold (shown in phantom) with the lid fully opened and showing interior storage boxes which are accessible when the lid is in a fully opened position and a recess provided for the handle.
Figure 3:
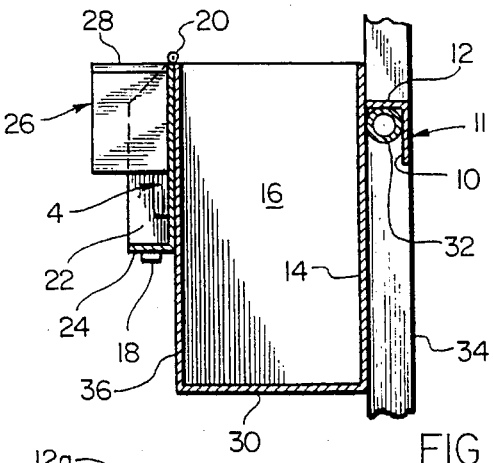
FIG. 3 is a side elevation view of the tool box taken along the line 3—3 of FIG. 2.

As shown in FIG. 3, the tool box 2 further comprises a horizontal lid hinge 20 operably connected to the lid 8. The axis of the hinge 20 is disposed along and operably connected to the upper surface of the vertical wall 36 of the box 2 that is opposite the vertical wall 14 of the box on which the means for suspending the box is disposed. The lid 8 is pivotally movable about the axis of the hinge 20 from a closed position with the lid 8 resting generally horizontally on top of said box 2 to an open position not to exceed 270° from the closed position. Arranging the lid hinge on the opposite wall from the wall supporting the hanger allows the lid to be opened without obstruction from the scaffold to which it may be suspended. The lid 8 may be easily opened and closed while the box is suspended from the scaffold. See FIG. 2.

As shown in FIG. 3 of the drawing, the means for suspending the box comprises at least one bracket 11, having a downwardly extending lip 10 spaced from the vertical wall 14 of the box 2, arranged and adapted to affix to a horizontal member 32 of a scaffold.

Figure 5:
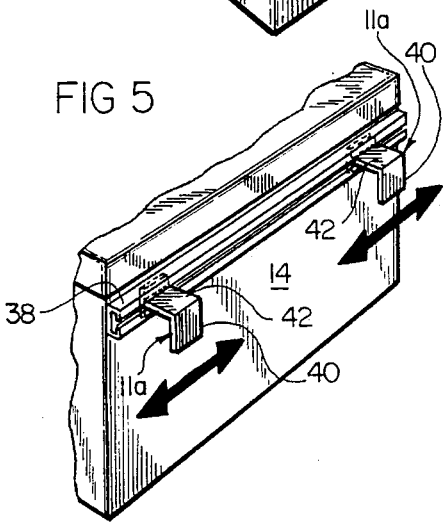
FIG. 5 is a fragmentary perspective view of the vertical wall of the tool box showing a second preferred embodiment of the means of suspending the box.

In another preferred embodiment of the invention, as shown in FIG. 5, the means for suspending the box comprises at least two brackets 11*a* and an elongated horizontal guide means 38. The guide means 38 are operably connected to one of the vertical walls 14 of the box 2 and are arranged and adapted to slidingly secure the brackets 11*a*. The brackets 11*a* may be positioned in the guide means to fit on a horizontal member 32 of varying lengths. The brackets 11*a* are disposed in a longitudinally horizontally slidable relationship with said elongated horizontal guide means 38. Each of the brackets 11*a* has a proximate end slideably disposed longitudinally within said elongated horizontal guide means 38 and a distal end arranged and adapted to affix to a horizontal surface. As best shown in FIG. 3, bracket 11 has an elongated generally horizontal surface 12 with a proximate longitudinal edge adjacent to the vertical wall 14 of the box 2 and a distal longitudinal edge connected to an upper edge of a downwardly disposed surface 10 of said elongated bracket 11.

Figure 4:
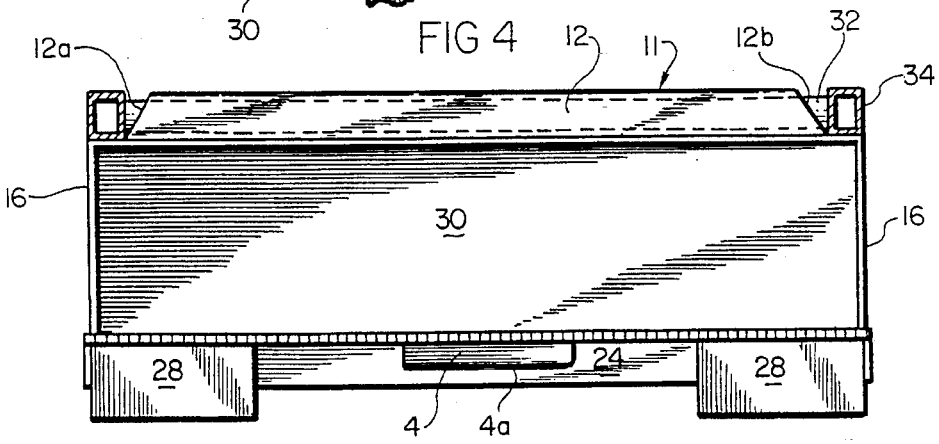
FIG. 4 is a top plan view of the tool box of FIG. 2.

As best shown in FIG. 2, a preferred embodiment of the invention provides for interior storage boxes 26 disposed on the bottom surface of the lid 8 (viewed in a closed position) which are accessible when the lid is in a fully opened position and a recessed handle 6. Although not depicted in the drawing, the tool box 2 can be adapted to include an internally disposed tool tray. Moreover, the storage trays, positioned as they are on the bottom surface of the lid 8, do not interfere with access to the interior of the tool box as shown in FIG. 4.

This improved tool box can best be made of twenty gauge galvanized steel for the exterior and twenty-six gauge galvanized steel for the interior.

The recess 4 for the handle 6 allows the lid 8 to be opened a full 270 degrees, so that the lid can be evenly disposed against the vertical wall 36 of the box 2 to minimize obstruction to its user.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

What I claim is:

1. An improved tool box, having a front wall, a rear wall and two side walls, each lying generally in a vertical plane, and a bottom wall lying generally in a horizontal plane, said front wall and said rear wall each having their bottom edges connected to the front edge and the rear edge, respectively, of the bottom wall, said side walls each having their bottom edges connected to the side edges, respectively, of the bottom wall, the front side edge of each of the side walls connected, respectively, to the side edge of the front wall, and the rear side edge of each of the side walls connected, respectively, to the side edge of the rear wall, a lid connected to at least one of the walls lying in a generally vertical plane, wherein the improvement comprises:

a. a means for suspending the box from an object while permitting free movement of the lid for opening and closing and without limiting movement of the lid by the object to which the box may be suspended, said means for suspending being operably connected to one of the vertical walls of said box, adapted to suspend said box from a horizontal member of a scaffold, said scaffold having the horizontal member supported on each end by a parallel vertical support member, and said means for suspending the box extends horizontally and is centrally disposed on said vertical wall and has a horizontal length that is less than the horizontal length of the vertical wall of the box to which the means for suspending the box is attached, wherein each end of the vertical wall of the box on which the means for suspending the box is disposed extending beyond the centrally disposed means for suspending the box defines a vertical section, and wherein each vertical section may be positioned adjacent to a parallel vertical support member of a scaffold having a horizontal member disposed between parallel vertical support members, whereby, rotational movement of the box about said horizontal member of a scaffold is obstructed by contact between each of said vertical sections and the adjacent parallel vertical support member; and b. a horizontal lid hinge operably connected to the lid and having an axis disposed along and operably connected to the vertical wall of the box that is opposite the vertical wall of the box on which the means for suspending the box is disposed, said lid being pivotally movable about the axis of said lid hinge from a closed position with the lid resting generally horizontally on top of said box to an open position, whereby, a scaffold from which the box may be suspended will not impede the use of the lid which may be opened and closed while the box is suspended from the scaffold.

2. The improved tool box as set forth in claim 1, wherein the means for suspending the box is disposed at a spaced distance from at least one of the side edges of the vertical wall of the box to which the means for suspending the box is attached, said spaced distance delimiting a section of the vertical wall of the box to which the means for suspending the box is attached, said spaced distance being sufficiently sized to allow the section to be placed in face to face relationship with one of the parallel vertical support members of a scaffold as the box is suspended from a horizontal member of the scaffold, whereby, rotational movement of the box about said horizontal member of the scaffold is obstructed.

3. An improved tool box as set forth in claim 1, wherein the means for suspending the box comprises at least one bracket, having a downwardly extending lip spaced from the wall of the box, adapted to affix to a horizontal member of a scaffold.

4. An improved tool box as set forth in claim 1, wherein the means for suspending the box comprises at least two brackets and an elongated horizontal means for guiding said brackets, each of said brackets having a proximate end slidably disposed longitudinally within said elongated horizontal means for guiding and a distal end adapted to affix to a horizontal member of a scaffold, said elongated horizontal means for guiding being operably connected to one of the vertical walls of the box and having the brackets slidably secured to said elongated horizontal means for guiding.

5. The improved tool box as set forth in claim 4, wherein each of the brackets has an elongated generally horizontal surface with a proximate longitudinal edge adjacent to the vertical wall of the box on which the means for suspending the box is operably connected and a distal longitudinal edge connected to an upper edge of a downwardly disposed surface thereof.

6. The improved tool box as set forth in claim 1, wherein the lid further comprises a bottom surface with interior storage boxes disposed thereon which are accessible when the lid is in a fully opened position, a recessed handle, and an internally disposed tool tray in said box.

7. An improved tool box as set forth in claim 1, wherein the lid is pivotally movable about the axis of the hinge from a closed position with the lid resting generally horizontally on top of said box to an open position with the lid positioned adjacent to the vertical wall of the box on which the lid hinge is operably connected, said lid being moveable about the hinge axis from the closed position through an angle of rotation of approximately 270° to a fully open position, whereby, the lid may be openly disposed adjacent to the box out of the way of a user.

8. The improved tool box as set forth in claim 1, wherein the lid further comprises a bottom surface with interior storage boxes disposed thereon, each of said interior storage boxes having a cover that is disposed horizontally when the lid is in an open position, said cover being secured in a closed position by the vertical wall to which the lid is attached when said lid is in the closed position;

a recessed handle; and an internally disposed tool tray in said box.

9. An improved tool box, having a front wall, a rear wall and two side walls, each lying generally in a vertical plane, and a bottom wall lying generally in a horizontal plane, said front wall and said rear wall each having their bottom edges connected to the front edge and the rear edge, respectively, of the bottom wall, said side walls each having their bottom edges connected to the side edges, respectively, of the bottom wall, the front side edge of each of the side walls connected, respectively, to the side edge of the front wall, and the rear side edge of each of the side walls connected, respectively, to the side edge of the rear wall, a lid connected to at least one of the walls lying in a generally vertical plane, wherein the improvement comprises a means for suspending the box from an object while permitting free movement of the lid for opening and closing and without limiting movement of the lid by the object to which the box may be suspended, said means for suspending being operably connected to one of the vertical walls of said box and comprising at least two brackets and an elongated horizontal means for guiding said brackets, each of said brackets having a proximate end slidably disposed longitudinally within said elongated horizontal means for guiding and a distal end adapted to affix to a horizontal surface, said elongated horizontal means for guiding being operably connected to one of the vertical walls of the box and having the brackets slidably secured to said elongated horizontal means for guiding.

10. An improved tool box as set forth in claim 9, wherein the width of the generally horizontal surface of each of the brackets is at least one and a half (1.5") inches.

11. A tool box having a front wall, a rear wall and two side walls, each lying generally in a vertical plane, and a bottom wall, lying generally in a horizontal plane, said front wall and said rear wall each having their bottom edges connected to the front edge and the rear edge, respectively, of the bottom wall, said side walls each having their bottom edges connected to the side edges, respectively, of the bottom wall, the front side edge of each of the side walls connected, respectively, to the side edge of the front wall, and the rear side edge of each of the side walls connected, respectively, to the side edge of the rear wall, a lid connected to at least one of the walls lying in a generally vertical plane, and a means for suspending the box from an object while permitting free movement of the lid for opening and closing and without limiting movement of the lid by the object to which the box may be suspended, said means for suspending being operably connected to one of the vertical walls of said box and comprising at least two brackets and an elongated horizontal means for guiding said brackets, each of said brackets having a proximate end slidably disposed longitudinally within said elongated horizontal means for guiding and a distal end adapted to affix to a horizontal surface, said elongated horizontal means for guiding being operably connected to one of the vertical walls of the box and having the brackets slidably secured to said elongated horizontal means for guiding.

12. A tool box having a front wall, a rear wall and two side walls, each lying generally in a vertical plane, and a bottom wall, lying generally in a horizontal plane, said front wall and said rear wall each having their bottom edges connected to the front edge and the rear edge, respectively, of the bottom wall, said side walls each having their bottom edges connected to the side edges, respectively, of the bottom wall, the front side edge of each of the side walls connected, respectively, to the side edge of the front wall, and the rear side edge of each of the side walls connected, respectively, to the side edge of the rear wall, a lid connected to at least one of the walls lying in a generally vertical plane, and a means for suspending the box from an object while permitting free movement of the lid for opening and closing and without limiting movement of the lid by the object to which the box may be suspended, said means for suspending being operably connected to one of the vertical walls of said box, extending horizontally and being centrally disposed on said vertical wall with a horizontal length that is less than the horizontal length of the vertical wall of the box to which the means for suspending the box is attached wherein each end of the vertical wall of the box on which the means for suspending the box is disposed extending beyond the centrally disposed means for suspending the box defines a vertical section, and wherein each vertical section positioned adjacent to a parallel vertical support member of a scaffold having a horizontal member disposed between parallel vertical support members, whereby, rotational movement of the box about said horizontal member of a scaffold is obstructed by contact between each of said vertical sections and the adjacent parallel vertical support member; and further comprising a horizontal lid hinge operably connected to the lid and having an axis disposed along and operably connected to the vertical wall of the box that is opposite the vertical wall of the box on which the means for suspending the box is disposed, said lid being pivotally movable about the axis of said lid hinge from a closed position with the lid resting generally horizontally on top of said box to an open position, whereby, a scaffold from which the box may be suspended will not impede the use of the lid which may be opened and closed while the box is suspended from the scaffold.

13. The tool box as set forth in claim 12, wherein the means for suspending the box comprises at least one bracket, having a downwardly extending lip spaced from the wall of the box, adapted to affix to a horizontal member of a scaffold.

14. The tool box as set forth in claim 12, wherein the means for suspending the box comprises at least two brackets and an elongated horizontal means for guiding said brackets, each of said brackets being disposed in a longitudinally horizontally slidable relationship with said elongated horizontal means for guiding, said elongated horizontal means for guiding being operably connected to one of the vertical walls of the box and having the brackets slidably secured to said elongated horizontal means for guiding.

* * * * *